US012504201B2

(12) United States Patent
Satou et al.

(10) Patent No.: US 12,504,201 B2
(45) Date of Patent: Dec. 23, 2025

(54) AIR CONDITIONER

(71) Applicant: DAIKIN INDUSTRIES, LTD., Osaka (JP)

(72) Inventors: Ken Satou, Osaka (JP); Tomohiko Sakamaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 268 days.

(21) Appl. No.: 17/739,977

(22) Filed: May 9, 2022

(65) Prior Publication Data

US 2022/0260277 A1 Aug. 18, 2022

Related U.S. Application Data

(63) Continuation of application No. PCT/JP2020/039501, filed on Oct. 21, 2020.

(30) Foreign Application Priority Data

Nov. 14, 2019 (JP) ..... 2019-205872

(51) Int. Cl.
*F24F 13/22* (2006.01)
*F24F 1/30* (2011.01)

(52) U.S. Cl.
CPC ..... *F24F 13/222* (2013.01); *F24F 1/30* (2013.01)

(58) Field of Classification Search
CPC .... F24F 13/222; F24F 1/30; F24F 1/36; F28F 2265/02; F28F 2265/22
See application file for complete search history.

(56) References Cited

U.S. PATENT DOCUMENTS 2,082,403 A * 6/1937 Larkin ..... F25B 41/45 285/125.1
4,748,828 A * 6/1988 Chang ..... F25D 21/14 62/272

(Continued)

FOREIGN PATENT DOCUMENTS

CN 207778628 U 8/2018
EP 2159497 A1 3/2010

(Continued)

OTHER PUBLICATIONS

JP-6808059-B2 Translation (Year: 2021).*

(Continued)

*Primary Examiner* — David J Teitelbaum
(74) *Attorney, Agent, or Firm* — Osha Bergman Watanabe & Burton LLP

(57) ABSTRACT

An air conditioner includes: a heat exchanger; a refrigerant flow divider causes a liquid refrigerant to be divided and to flow to the heat exchanger; and a case that includes a bottom plate, and accommodates the heat exchanger and the refrigerant flow divider. A first drain unit having a first opening for drainage is disposed on the bottom plate. The refrigerant flow divider includes: a flow divider body including a branching flow path; and refrigerant tubes that project downward from a lower surface of the flow divider body and then bend upward to connect to the heat exchanger at a position above the lower surface. All of the refrigerant tubes have lowermost ends that overlap with the first drain unit when viewed in a vertical direction.

9 Claims, 11 Drawing Sheets

(56) References Cited

U.S. PATENT DOCUMENTS

| | | | | |
|---|---|---|---|---|
| 11,137,184 | B2 | 10/2021 | Yamada et al. | |
| 2006/0048928 | A1 | 3/2006 | Maezawa et al. | |
| 2008/0202738 | A1* | 8/2008 | Nelson | F28F 21/08 165/174 |
| 2014/0338384 | A1 | 11/2014 | Koike et al. | |
| 2017/0241684 | A1* | 8/2017 | Ito | F28F 9/0275 |
| 2018/0058736 | A1* | 3/2018 | Jin | F28F 9/182 |
| 2018/0094860 | A1 | 4/2018 | Sakamaki et al. | |
| 2019/0383501 | A1 | 12/2019 | Hasegawa et al. | |

FOREIGN PATENT DOCUMENTS

| | | | | |
|---|---|---|---|---|
| EP | 2876385 | A2 * | 5/2015 | F25B 31/006 |
| EP | 3748275 | A1 | 12/2020 | |
| JP | 2008-256304 | A | 10/2008 | |
| JP | 2013-113513 | A | 6/2013 | |
| JP | 2018-054256 | A | 4/2018 | |
| JP | 6522178 | B1 | 5/2019 | |
| JP | 2019-132537 | A | 8/2019 | |
| JP | 6808059 | B2 * | 1/2021 | F24F 1/22 |
| WO | 2004/025207 | A1 | 3/2004 | |
| WO | 2018/025356 | A1 | 2/2018 | |

OTHER PUBLICATIONS

EP-2876385-A2 Translation (Year: 2015).*

English translation of International Preliminary Report on Patentability issued in corresponding International Application No. PCT/JP2020/039501, mailed May 17, 2022 (5 pages).

International Search Report issued in corresponding International Application No. PCT/JP2020/039501 mailed Dec. 8, 2020 (3 pages).

Extended European Search Report issued in corresponding European Patent Application No. EP 20886399.3 dated Nov. 17, 2022 (9 pages).

* cited by examiner

AIR CONDITIONER

TECHNICAL FIELD

The present disclosure relates to an air conditioner.

BACKGROUND

PATENT LITERATURE 1 discloses an air conditioner including a heat exchanger and a refrigerant flow divider configured to divide a liquid refrigerant into a plurality of paths and flow the refrigerant into the heat exchanger. The refrigerant flow divider includes a flow divider body having an internal branching flow path, and a plurality of refrigerant tubes connected to a lower surface of the flow divider body. The refrigerant tubes are each connected to a liquid header of the heat exchanger.

PATENT LITERATURE

PATENT LITERATURE 1: Japanese Patent No. 6522178

SUMMARY

The present disclosure provides an air conditioner including:

a heat exchanger;

a refrigerant flow divider configured to divide and flow a liquid refrigerant to the heat exchanger; and a case including a bottom plate and accommodating the heat exchanger and the refrigerant flow divider; in which the bottom plate is provided with a first drain unit having a first opening for drainage, the refrigerant flow divider includes a flow divider body having a branching flow path, and a plurality of refrigerant tubes that is projecting downward from a lower surface of the flow divider body, is then bent, and is connected to the heat exchanger at a position above the lower surface, and all the refrigerant tubes have lowermost ends positioned to be vertically overlapped with the first drain unit.

DETAILED DESCRIPTION

Description will be made hereinafter to embodiments of the present disclosure.

Figure 1:
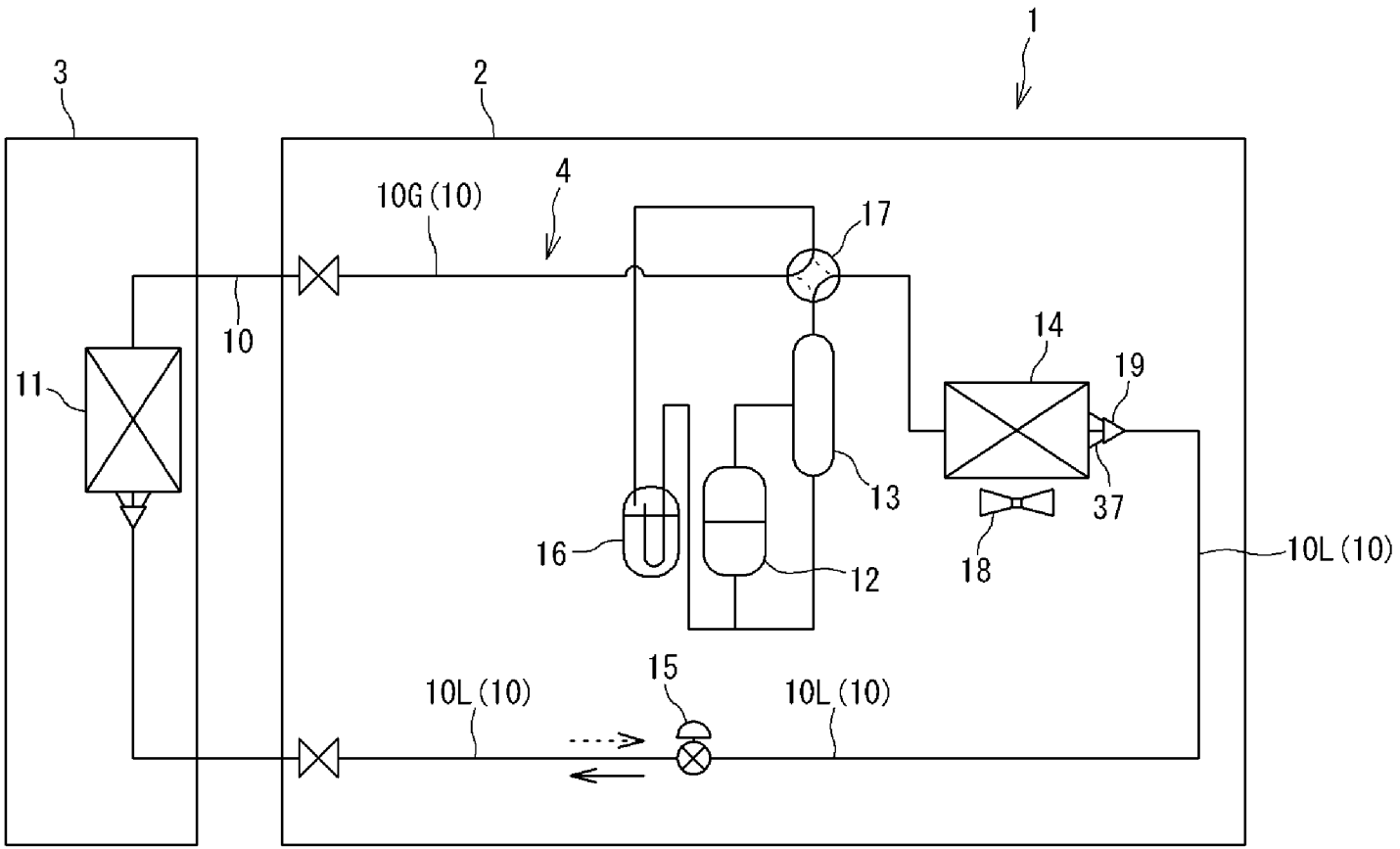
FIG. 1 is a schematic configuration diagram of an air conditioner according to one or more embodiments of the present disclosure.

FIG. 1 is a schematic configuration diagram of an air conditioner according to one or more embodiments of the present disclosure.

An air conditioner 1 includes an outdoor unit 2 disposed outdoors and an indoor unit 3 disposed indoors. The outdoor unit 2 and the indoor unit 3 are connected to each other by a connection pipe. The air conditioner 1 includes a refrigerant circuit 4 configured to execute vapor compression refrigeration cycle operation. The refrigerant circuit 4 is provided with an indoor heat exchanger 11, a compressor 12, an oil separator 13, an outdoor heat exchanger 14, an expansion valve (expansion mechanism) 15, an accumulator 16, a four-way switching valve 17, and the like, which are connected by a refrigerant pipe 10. The refrigerant pipe 10 includes a liquid pipe 10L and a gas pipe 10G.

The indoor heat exchanger 11 is configured to execute heat exchange between a refrigerant and indoor air, and is provided in the indoor unit 3. Examples of the indoor heat exchanger 11 include a fin-and-tube heat exchanger of a cross-fin type and a heat exchanger of a microchannel type. The indoor heat exchanger 11 is provided therearound with an indoor fan (not depicted) configured to send indoor air to the indoor heat exchanger 11.

The compressor 12, the oil separator 13, the outdoor heat exchanger 14, the expansion valve 15, the accumulator 16, and the four-way switching valve 17 are provided in the outdoor unit 2.

The compressor 12 is configured to compress a refrigerant sucked from a suction port and discharge the compressed refrigerant from a discharge port. Examples of the compressor 12 include various compressors such as a scroll compressor.

The oil separator 13 is configured to separate lubricant from fluid mixture that contains the lubricant and a refrigerant and is discharged from the compressor 12. The refrigerant thus separated is sent to the four-way switching valve 17 whereas the lubricant is returned to the compressor 12.

The outdoor heat exchanger 14 is configured to execute heat exchange between a refrigerant and outdoor air. The outdoor heat exchanger 14 according to one or more embodiments is of the microchannel type. The outdoor heat exchanger 14 is provided therearound with an outdoor fan 18 configured to send outdoor air to the outdoor heat exchanger 14. The outdoor heat exchanger 14 has a liquid side end provided with a refrigerant flow divider 19 including a capillary tube 37.

The expansion valve 15 is disposed between the outdoor heat exchanger 14 and the indoor heat exchanger 11 in the refrigerant circuit 4, and expands an incoming refrigerant to be decompressed to have predetermined pressure. Examples of the expansion valve 15 include an electronic expansion valve having a variable opening degree.

The accumulator 16 is configured to separate an incoming refrigerant into a gas refrigerant and a liquid refrigerant, and is disposed between the suction port of the compressor 12 and the four-way switching valve 17 in the refrigerant circuit 4. The gas refrigerant thus separated at the accumulator 16 is sucked into the compressor 12.

The four-way switching valve 17 is configured to be switchable between a first state indicated by solid lines in FIG. 1 and a second state indicated by broken lines. The four-way switching valve 17 is switched into the first state while the air conditioner 1 executes cooling operation, and the four-way switching valve 17 is switched into the second state while the air conditioner 1 executes heating operation.

When the air conditioner 1 executes cooling operation, the outdoor heat exchanger 14 functions as a refrigerant condenser and the indoor heat exchanger 11 functions as a refrigerant evaporator. A gas refrigerant discharged from the compressor 12 condenses at the outdoor heat exchanger 14, is then decompressed at the expansion valve 15, and evaporates at the indoor heat exchanger 11 to be sucked into the compressor 12. Also during defrosting operation of removing frost formed on the outdoor heat exchanger 14 or the like using heating operation, the outdoor heat exchanger 14 functions as a refrigerant condenser and the indoor heat exchanger 11 functions as a refrigerant evaporator, as in cooling operation.

When the air conditioner 1 executes heating operation, the outdoor heat exchanger 14 functions as a refrigerant evaporator and the indoor heat exchanger 11 functions as a refrigerant condenser. A gas refrigerant discharged from the compressor 12 condenses at the indoor heat exchanger 11, is then decompressed at the expansion valve 15, and evaporates at the outdoor heat exchanger 14 to be sucked into the compressor 12.

[Configuration of Outdoor Heat Exchanger]

Figure 2:
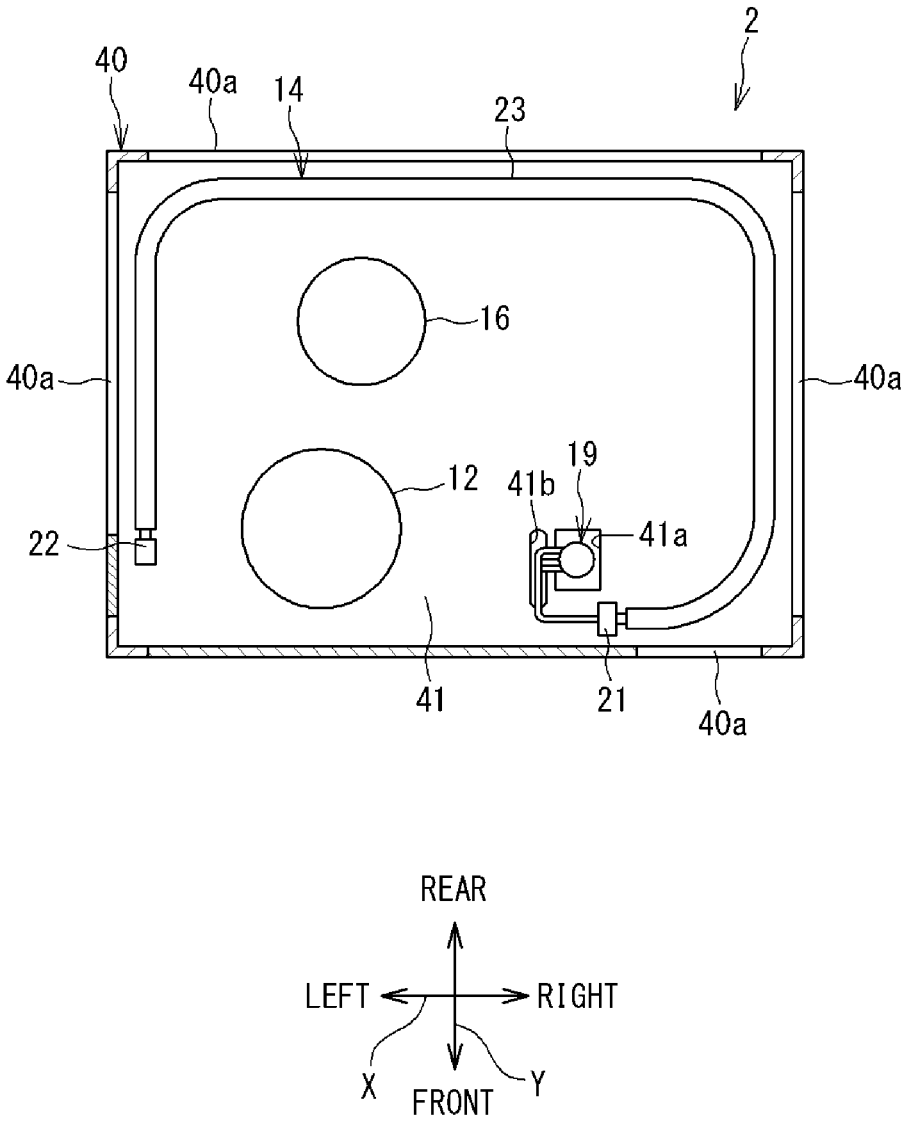
FIG. 2 is a plan view depicting an interior of the air conditioner.
Figure 3:
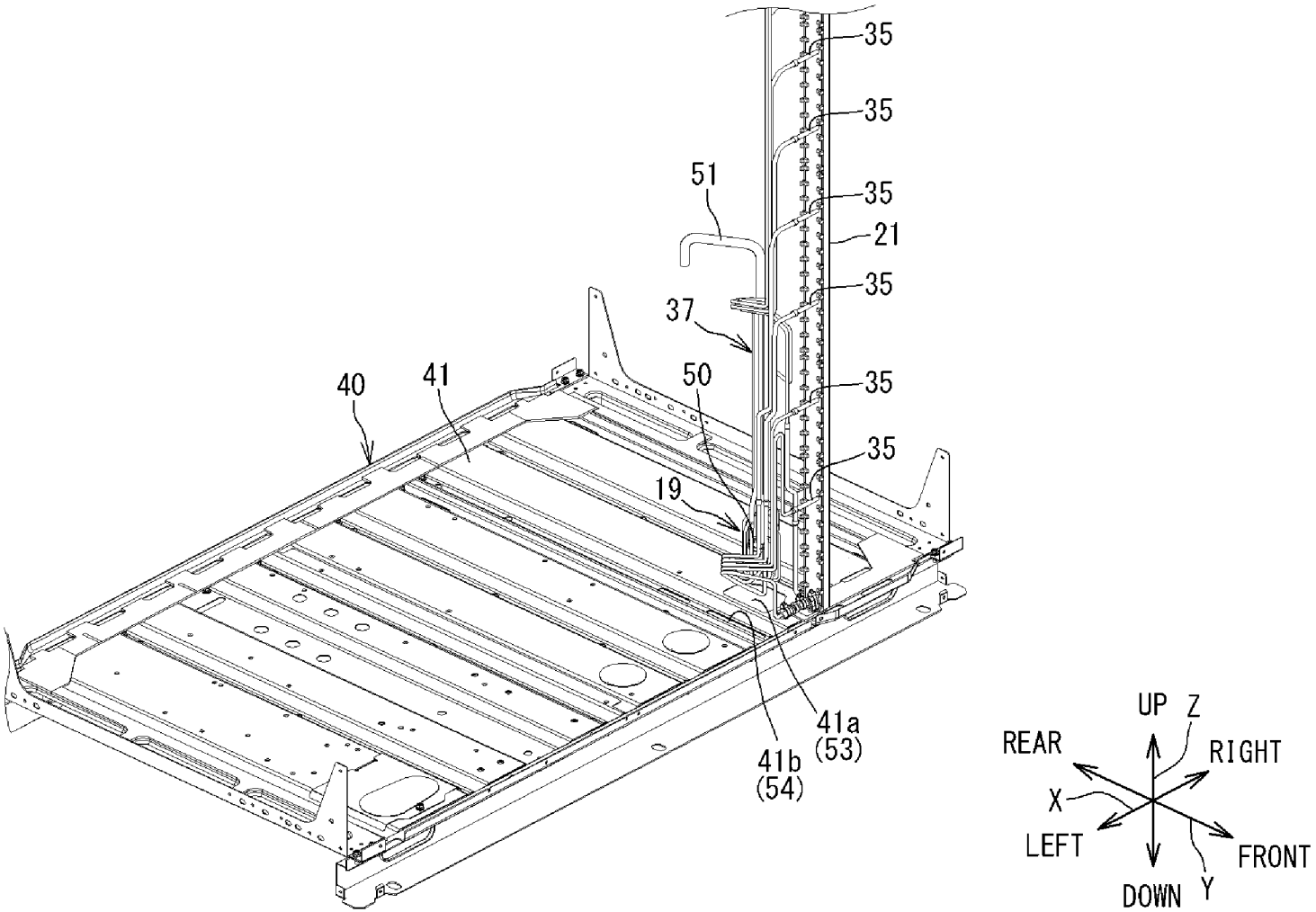
FIG. 3 is a perspective view depicting a bottom plate, a liquid header, and a refrigerant flow divider included in the air conditioner.
Figure 4:
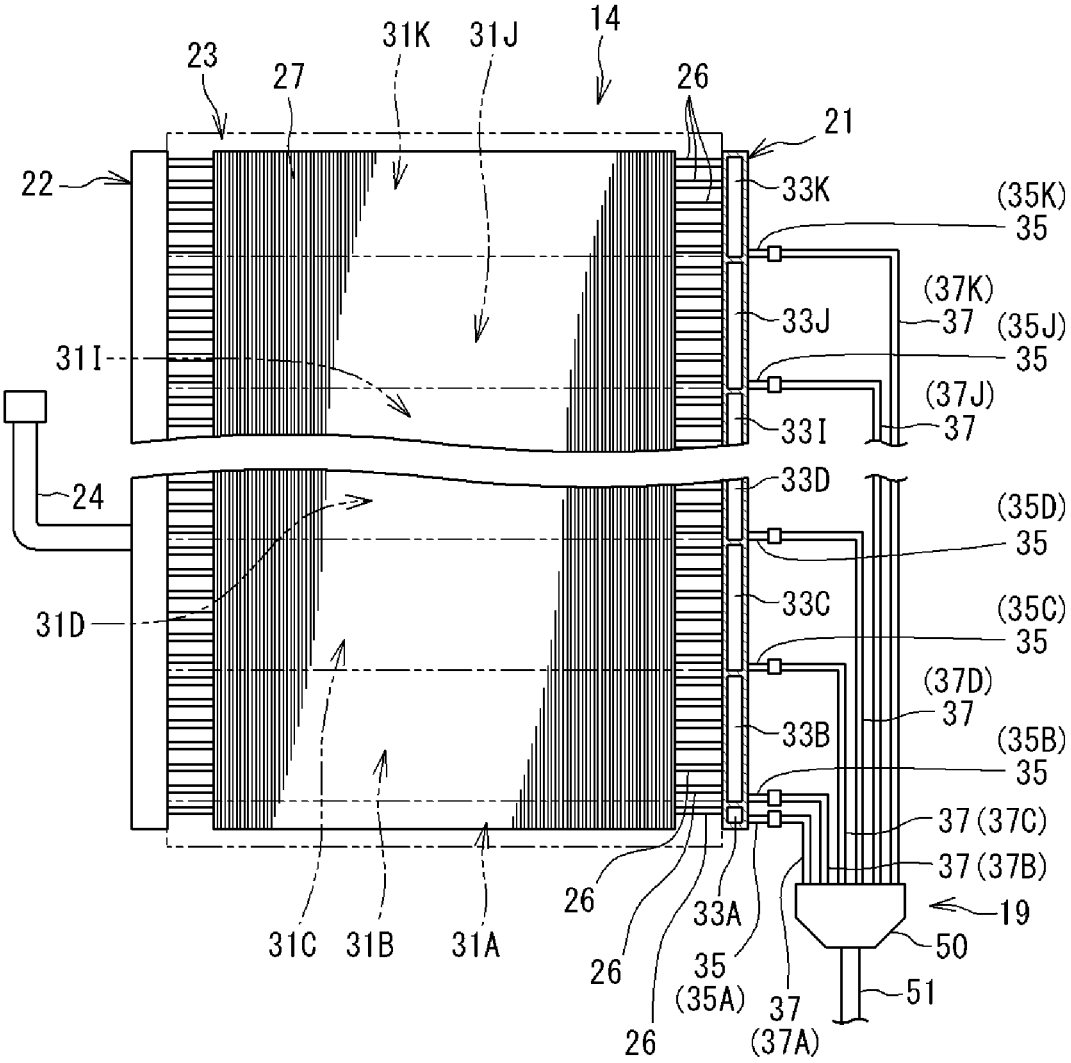
FIG. 4 is a schematic developed view depicting an outdoor heat exchanger.

FIG. 2 is a plan view depicting an interior of the air conditioner. FIG. 3 is a perspective view depicting a bottom plate of a case, a liquid header, and the refrigerant flow divider in the air conditioner. FIG. 4 is a schematic developed view depicting the outdoor heat exchanger.

The following description may include expressions such as "up", "down", "left", "right", "front (before)", and "rear (behind)", for indication of directions and positions. These expressions follow directions indicated by arrows in FIG. 3, unless otherwise specified. Specifically, the following description assumes that directions indicated by the arrow X in FIG. 3 are lateral directions, directions indicated by the arrow Y are front and rear directions, and directions indicated by the arrow Z is vertical directions. These expressions describing the directions and the positions are adopted for convenience of description, and do not limit, unless otherwise specified, directions or positions of the entire outdoor heat exchanger 14 and various constituents of the outdoor heat exchanger 14 to the directions or the positions described herein.

As depicted in FIG. 2, the outdoor unit 2 includes a case 40. The case 40 has a rectangular parallelepiped shape. The case 40 accommodates the compressor 12, the oil separator 13, the outdoor heat exchanger 14, the expansion valve 15, the accumulator 16, the four-way switching valve 17, the outdoor fan 18, and the like described earlier. FIG. 2 depicts, among these constituents, the compressor 12, the outdoor heat exchanger 14, and the accumulator 16, which are disposed on a bottom plate 41 of the case 40. As depicted in FIG. 2 and FIG. 3, the bottom plate 41 has a rectangular shape. The bottom plate 41 is provided with openings 41*a* and 41*b* for drainage, as to be described later.

The outdoor heat exchanger 14 according to one or more embodiments faces four surfaces, namely, a left side surface, a rear surface, a right side surface, and a front surface of the case 40 in a planar view (top view). Part of the outdoor heat exchanger 14 facing the front surface of the case 40 is shorter than a length of the case 40 in lateral directions X to face only end portions in the lateral directions X of the front surface of the case 40. The surfaces of the case 40 facing the outdoor heat exchanger 14 are each provided with an opening 40*a* for air supply. The outdoor heat exchanger 14 includes a pair of headers 21 and 22, and a heat exchanger body 23. The pair of headers 21 and 22 and the heat exchanger body 23 are made of aluminum or an aluminum alloy.

The pair of headers 21 and 22 are disposed at respective ends of the heat exchanger body 23 in a planar view. The header 21 is a liquid header configured to allow a liquid refrigerant (gas-liquid two-phase refrigerant) to flow therein. The header 22 is a gas header configured to allow a gas refrigerant to flow therein. The liquid header 21 and the gas header 22 are disposed to have longitudinal directions aligned to vertical directions Z.

As depicted in FIG. 4, the liquid header 21 is connected with the refrigerant flow divider 19. The refrigerant flow divider 19 includes a flow divider body 50 provided therein with a branching flow path, a main tube 51 extending from a first end of the flow divider body 50, and a plurality of capillary tubes 37 extending from a second end of the flow divider body 50. The main tube 51 is connected to the expansion valve 15 (see FIG. 1). The capillary tubes 37 are each connected to the liquid header 21 via a connecting tube 35. The gas header 22 is connected with a gas pipe 24.

The heat exchanger body 23 is configured to execute heat exchange between a refrigerant flowing inside and air. As depicted in FIG. 4, the heat exchanger body 23 includes a plurality of heat transfer tubes 26 and a plurality of fins 27. The heat transfer tubes 26 are disposed horizontally. The plurality of heat transfer tubes 26 is aligned in the vertical directions Z. Each of the heat transfer tubes 26 has a first longitudinal end portion connected to the liquid header 21. Each of the heat transfer tubes 26 has a second longitudinal end portion connected to the gas header 22.

Examples of the heat transfer tubes 26 include a flat porous tube having a plurality of holes serving as refrigerant flow paths and aligned horizontally. The plurality of fins 27 is aligned longitudinally along the heat transfer tubes 26. The refrigerant unidirectionally flows from the liquid header 21 to the gas header 22 through the heat exchanger body 23, or unidirectionally flows from the gas header 22 to the liquid header 21 through the heat exchanger body 23.

The heat exchanger body 23 exemplarily depicted in FIG. 4 includes a plurality of heat exchange units 31A to 31K. The plurality of heat exchange units 31A to 31K is aligned in the vertical directions Z. The liquid header 21 has an interior vertically zoned respectively for the heat exchange units 31A to 31K. In other words, as depicted in FIG. 3, the interior of the liquid header 21 is provided with flow paths 33A to 33K respectively for the heat exchange units 31A to 31K.

The liquid header 21 is connected with a plurality of connecting tubes 35A to 35K. The connecting tubes 35A to 35K are provided correspondingly to the flow paths 33A to 33K. The connecting tubes 35A to 35K are connected with capillary tubes 37A to 37K of the refrigerant flow divider 19.

During heating operation, a liquid refrigerant obtained at the refrigerant flow divider 19 flows through the capillary tubes 37A to 37K and the connecting tubes 35A to 35K, flows into the flow paths 33A to 33K in the liquid header 21, and flows through one or a plurality of heat transfer tubes 26 connected to the flow paths 33A to 33K to reach the gas header 22. In contrast, during cooling operation or defrosting operation, the refrigerant divided at the gas header 22 into the heat transfer tubes 26 flows into the flow paths 33A to 33K of the liquid header 21, and flows from the flow paths 33A to 33K to the capillary tubes 37A to 37K to join at the flow divider body 50.

The gas header 22 has an interior not zoned but extending continuously across all the heat exchange units 31A to 31K. The refrigerant flowing from the single gas pipe 24 into the gas header 22 is accordingly divided into all the heat transfer tubes 26, and the refrigerant flowing from all the heat transfer tubes 26 into the gas header 22 is joined at the gas header 22 to flow into the single gas pipe 24.

The heat exchange units 31A to 31K, the flow paths 33A to 33K in the liquid header 21, the connecting tubes 35A to 35K, and the capillary tubes 37A to 37K are equal in the number thereof, and FIG. 4 exemplarily depicts a case where the number is eleven. However, the number is not limited to eleven.

[Configuration of Refrigerant Flow Divider]

Figure 5A:
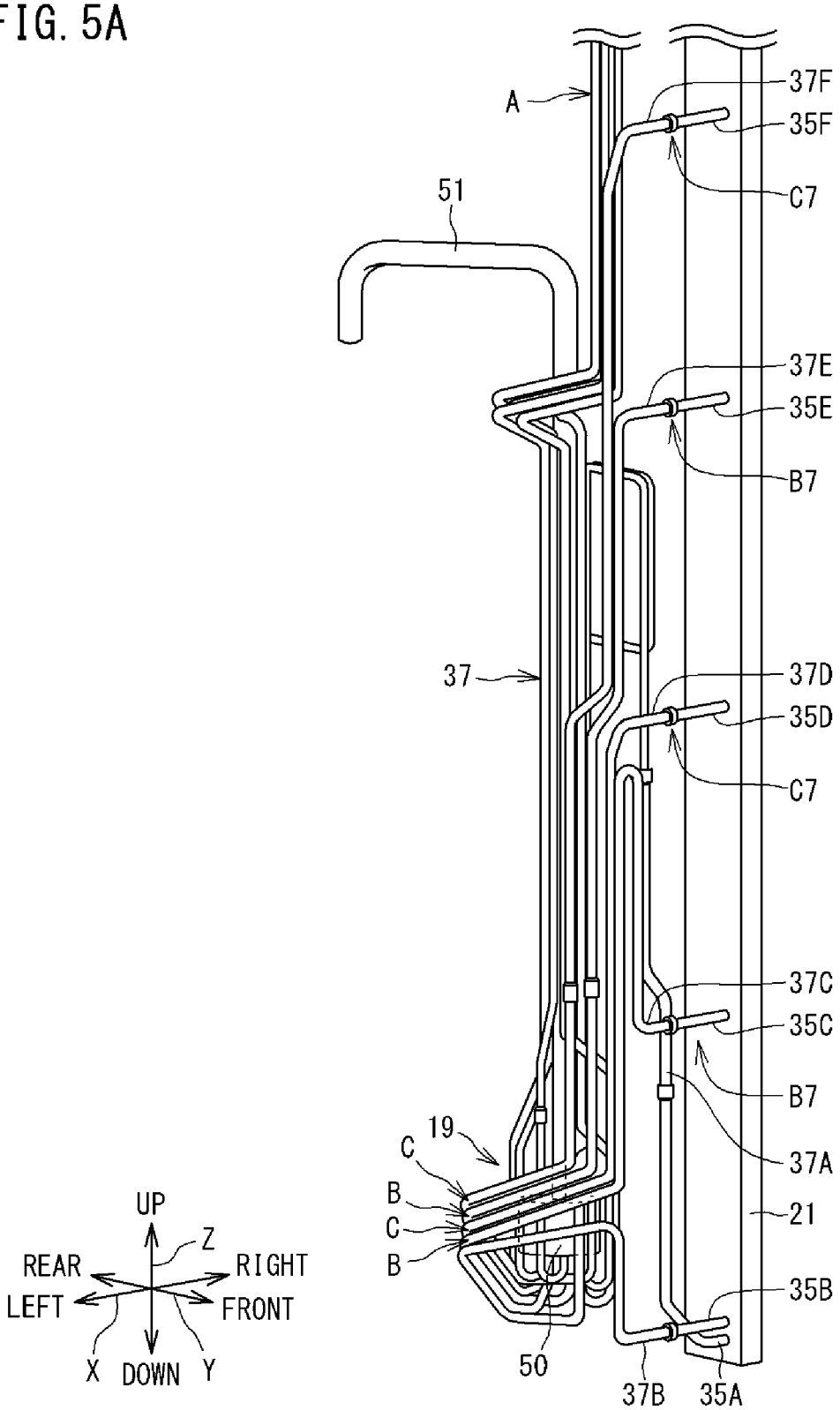
FIG. 5A is a perspective view depicting lower portions of the liquid header and the refrigerant flow divider.
Figure 5B:
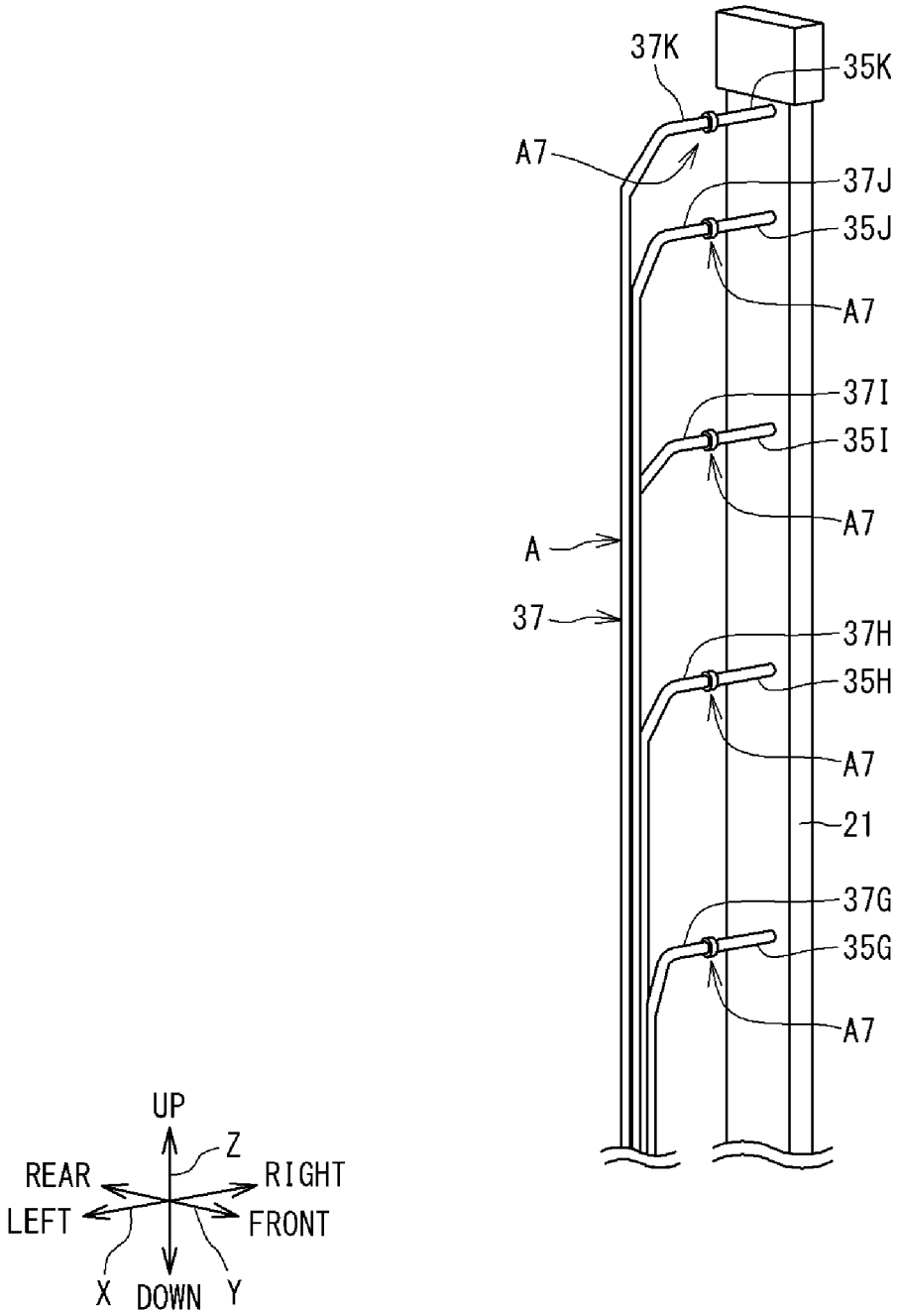
FIG. 5B is a perspective view depicting upper portions of the liquid header and the refrigerant flow divider.
Figure 6:
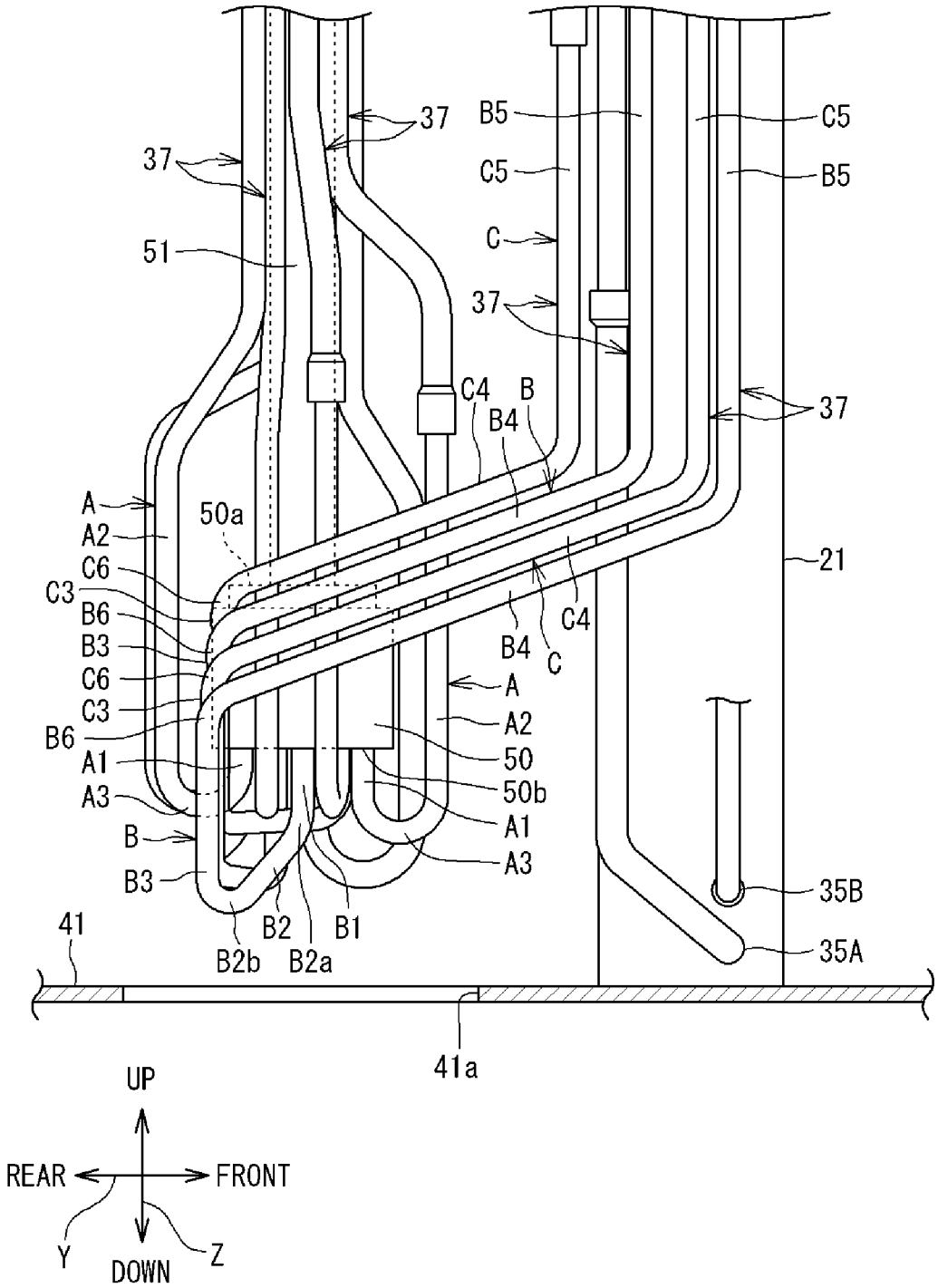
FIG. 6 is a left side view partially depicting the liquid header and the refrigerant flow divider.
Figure 7:
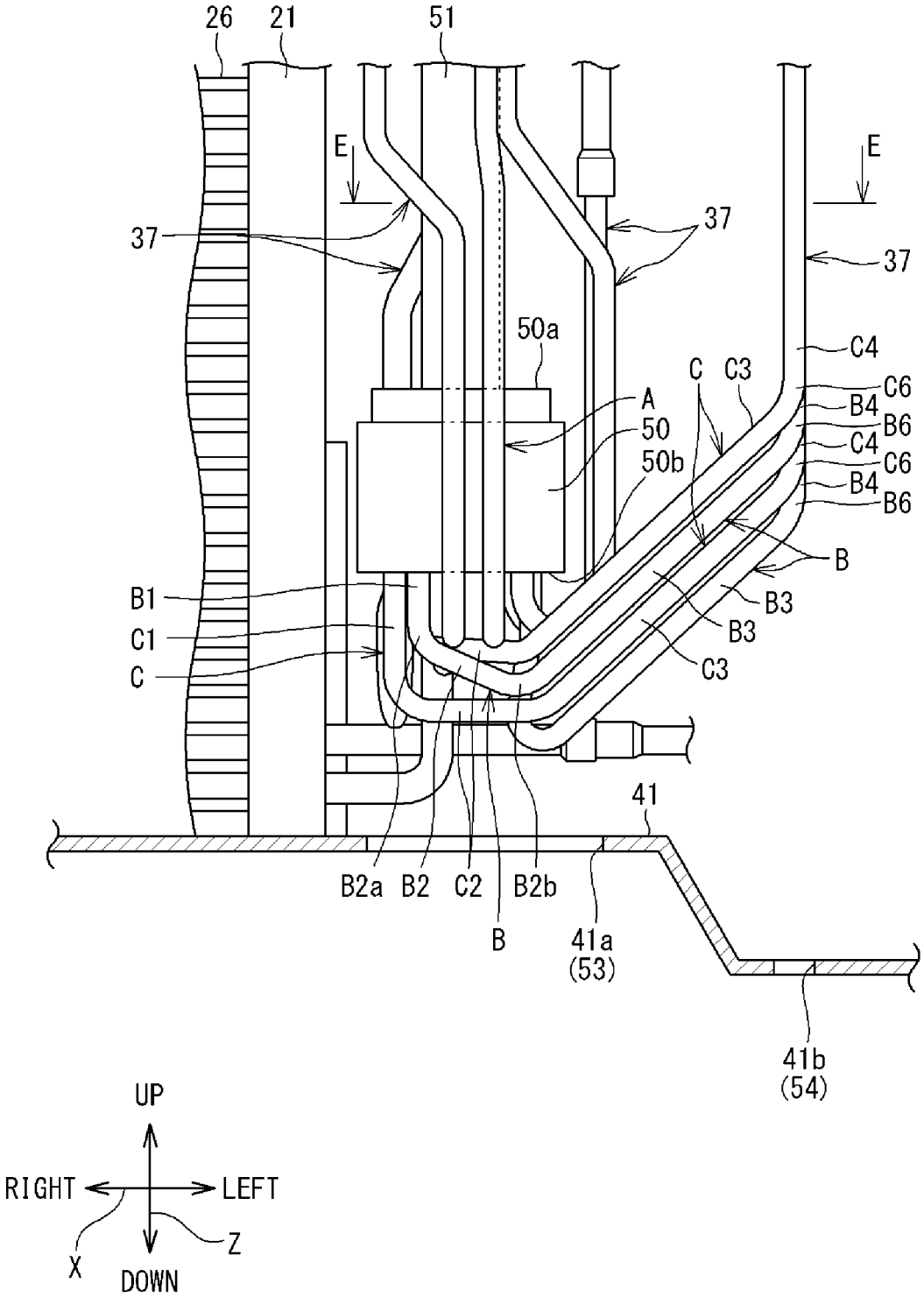
FIG. 7 is a rear view partially depicting the liquid header and the refrigerant flow divider.
Figure 8:
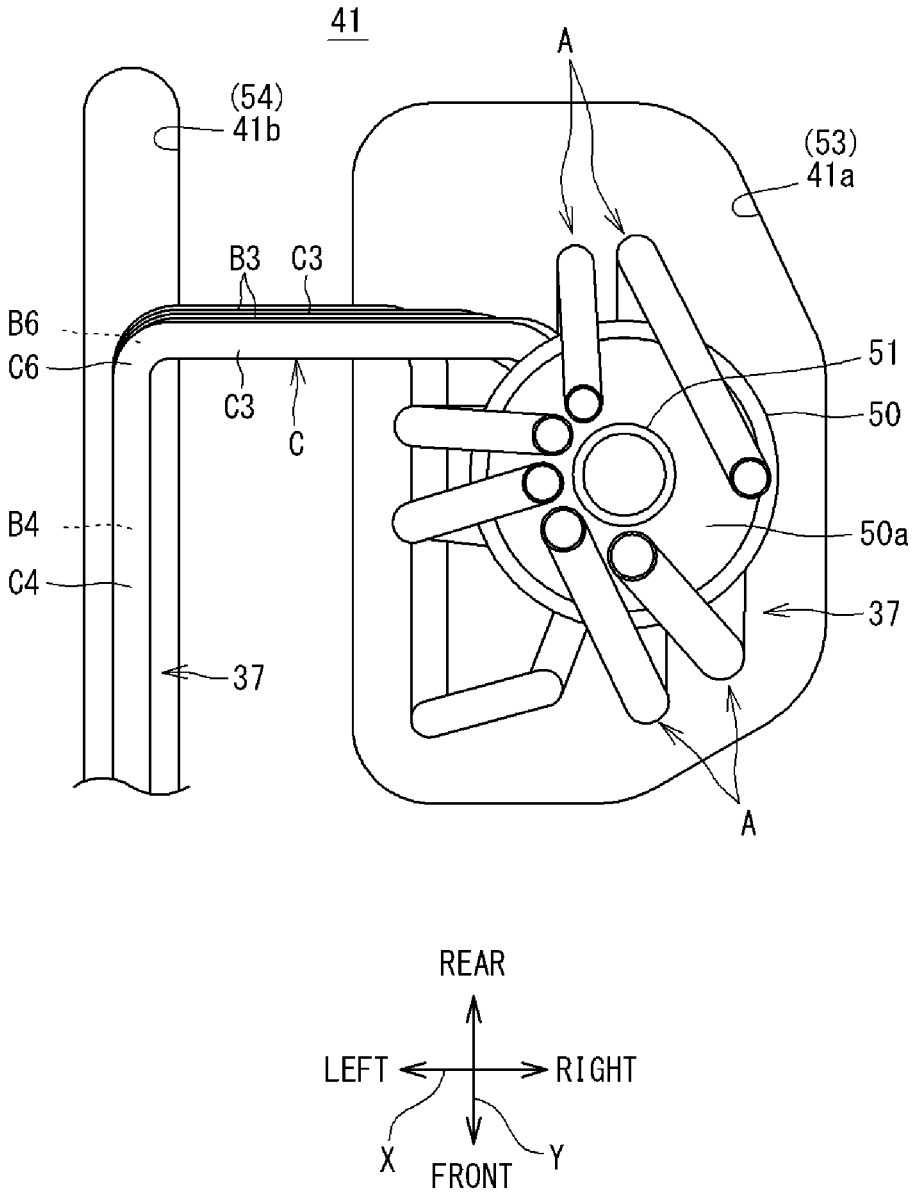
FIG. 8 is a sectional view taken along line E-E indicated in FIG. 7.
Figure 9:
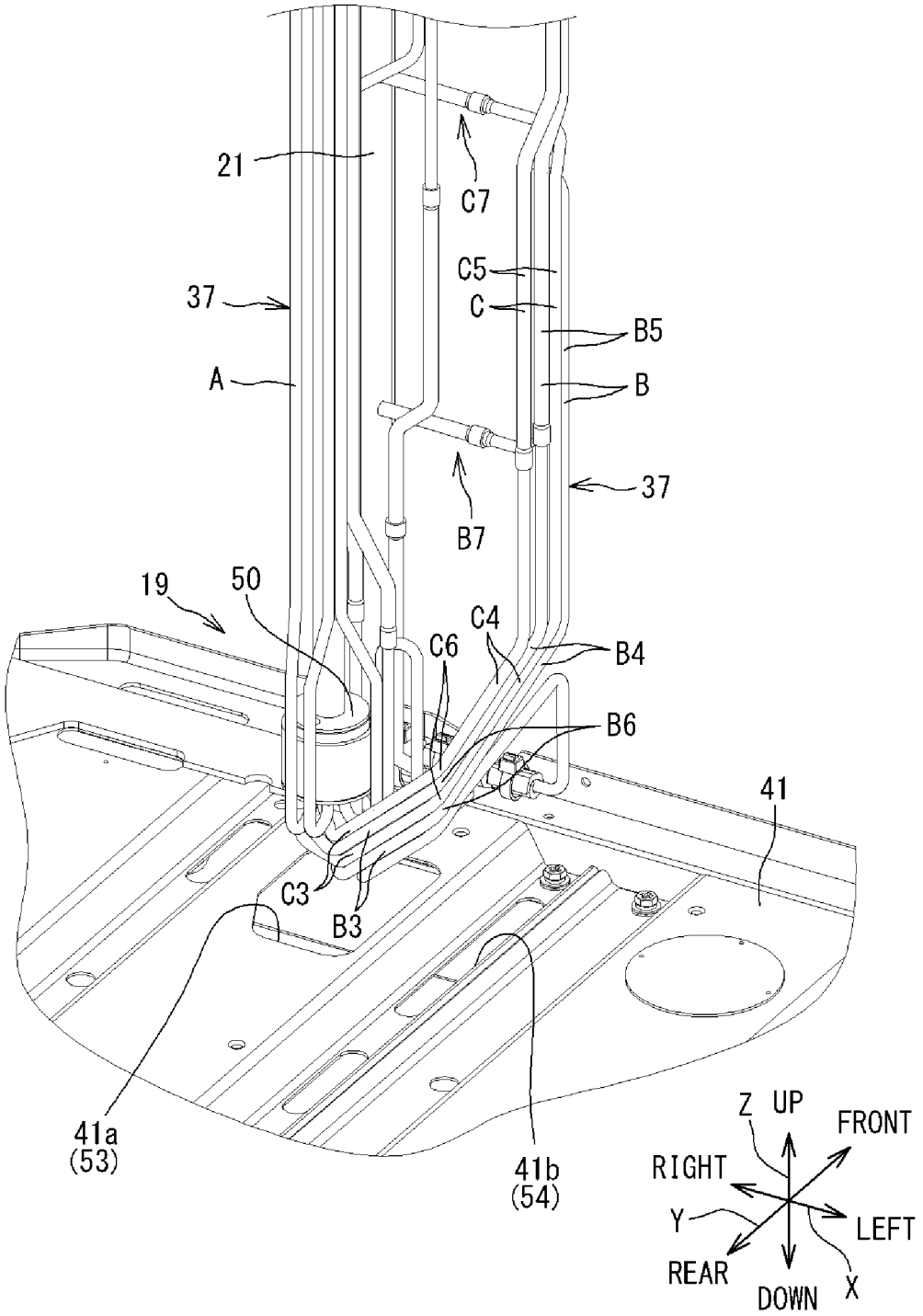
FIG. 9 is a perspective view from diagonally behind and above, partially depicting the bottom plate and the refrigerant flow divider.

FIG. 5A is a perspective view depicting lower portions of the liquid header and the refrigerant flow divider. FIG. 5B is a perspective view depicting upper portions of the liquid header and the refrigerant flow divider. FIG. 6 is a left side view partially depicting the liquid header and the refrigerant flow divider. FIG. 7 is a rear view partially depicting the liquid header and the refrigerant flow divider. FIG. 8 is a sectional view taken along line E-E indicated in FIG. 7. FIG. 9 is a perspective view from diagonally behind and above, partially depicting the bottom plate and the refrigerant flow divider.

As depicted in FIG. 2, FIG. 3, FIG. 6, and FIG. 7, the refrigerant flow divider 19 is disposed diagonally backward left with respect to the liquid header 21 of the outdoor heat exchanger 14. As depicted also in FIG. 5A, FIG. 5B, and FIG. 8, the refrigerant flow divider 19 includes the flow divider body 50, the main tube 51, and the capillary tubes 37 (37A to 37K).

The flow divider body 50 has a cylindrical shape having a central axis disposed along the vertical directions Z. The flow divider body 50 is provided therein with the branching flow path.

The flow divider body 50 has an upper surface (a first end surface in the vertical directions Z) 50*a* connected with the single main tube 51. The main tube 51 extends upward from the upper surface 50*a* of the flow divider body 50. The main tube 51 is connected to the expansion valve 15 (see FIG. 1) via a different refrigerant pipe or the like. As depicted in FIG. 8, the main tube 51 is connected to a center of a circular shape of the upper surface 50*a* of the flow divider body 50.

The flow divider body 50 has a lower surface (a second end surface in the vertical directions Z) 50*b* connected with the plurality of capillary tubes 37. The capillary tubes 37 project downward from the lower surface 50*b* of the flow divider body 50, are then bent and extend upward to reach above the lower surface 50*b* of the flow divider body 50.

Described below are some of the capillary tubes 37 connected to the lower surface 50*b* of the flow divider body 50 and connected to the liquid header 21 of the outdoor heat exchanger 14 at a position above the lower surface 50*b* of the flow divider body 50, specifically, the capillary tubes 37C to 37K other than the capillary tubes 37A and 37B connected to the lowermost connecting tube 35A and the second lowermost connecting tube 35B in FIG. 5A and FIG. 5B.

Hereinafter, the capillary tubes 37 and the connecting tubes 35 projecting from the liquid header 21 will be collectively and simply called "refrigerant tubes". The refrigerant tubes can be categorized into the following three types:

(1) As denoted by reference sign A in FIG. 6, a first refrigerant tube A including a first connecting portion A1 projecting downward from the lower surface 50*b* of the flow divider body 50 and a vertical portion A2 bent by about 180 degrees from a lower end of the first connecting portion A1 and extending upward;

(2) As denoted by reference sign B in FIG. 6 and FIG. 7, a second refrigerant tube B including a first connecting portion B1 projecting downward from the lower surface 50*b* of the flow divider body 50 and a first slant portion B2 slantly extending from a lower end of the first connecting portion B1; and (3) As denoted by reference sign C in FIG. 7, a third refrigerant tube C including a first connecting portion C1 projecting downward from the lower surface 50*b* of the flow divider body 50 and a horizontal portion C2 bent from a lower end of the first connecting portion C1 and extending substantially horizontally.

As depicted in FIG. 6 to FIG. 9, below the flow divider body 50, the bottom plate 41 of the case 40 is provided with a first drain unit 53 having a first opening 41*a* for drainage. The first to third refrigerant tubes A to C have lowermost ends positioned to be vertically overlapped with the first opening 41*a*.

Specifically, as depicted in FIG. 6, the first refrigerant tube A is curved into a U shape between the first connecting portion A1 and the vertical portion A2, and such a portion thus curved (curved portion) A3 constitutes the lowermost end of the first refrigerant tube A. The curved portion A3 is positioned to be vertically overlapped with the first opening 41*a*.

As depicted in FIG. 6 and FIG. 7, the first slant portion B2 in the second refrigerant tube B has a first end B2*a* positioned adjacent to the first connecting portion B1 and at a higher level, and a second end B2*b* positioned at a lower level. The second end B2*b* of the first slant portion B2 constitutes the lowermost end. The second end B2*b* of the first slant portion B2 is positioned to be vertically overlapped with the first opening 41*a*. The first slant portion B2 is slant with respect to the horizontal direction by an angle having 15 or more degrees.

As depicted in FIG. 7, the horizontal portion C2 constitutes the lowermost end in the third refrigerant tube C. The horizontal portion C2 is thus entirely positioned to be vertically overlapped with the first opening 41*a*.

Accordingly, the lowermost ends A3, B2*b*, and C2 of the first to third refrigerant tubes A to C are positioned to be vertically overlapped with the first opening 41*a*. In other words, the first opening 41*a* is sized to include lower regions of the lowermost ends A3, B2*b*, and C2 of the first refrigerant tube A, the second refrigerant tube B, and the third refrigerant tube C.

During heating operation, a condensed liquid refrigerant flows in the main tube 51 of the refrigerant flow divider 19 and is divided at the flow divider body 50 to flow in the refrigerant tubes A, B, and C. The refrigerant flowing in the refrigerant tubes A, B, and C is decompressed to be decreased in temperature and comes into a gas-liquid two-phase refrigerant lower in temperature than outdoor air. Outdoor air around the refrigerant tubes A, B, and C is cooled in this case, so that condensate or frost may be formed on the refrigerant tubes A, B, and C. While defrosting operation is executed to remove frost formed on the refrigerant tubes A, B, and C, the frost melts and water may adhere to the refrigerant tubes A, B, and C.

In such a case where water adheres to the refrigerant tubes A, B, and C, the water flows downward along the refrigerant tubes A, B, and C and drops from the lowermost ends A3, B2*b*, and C2 of the refrigerant tubes A, B, and C. The lowermost ends A3, B2*b*, and C2 of the refrigerant tubes A, B, and C are positioned to be vertically overlapped with the first opening 41*a* in one or more embodiments. Water drops from the lowermost ends A3, B2*b*, and C2 of the refrigerant tubes A, B, and C is thus exhausted outside from the first opening 41*a*. This inhibits water from freezing on the bottom plate 41 and an ice-up phenomenon of growing ice upward.

As depicted in FIG. 6 to FIG. 9, the second refrigerant tube B includes the first connecting portion B1 and the first slant portion B2, as well as a second slant portion B3 and a third slant portion B4. The second slant portion B3 is bent from the end portion B2*b*, far from the first connecting portion B1, of the first slant portion B2, and extends slantly with respect to the horizontal direction. The second slant portion B3 is continuous to the lowermost end B2*b* of the second refrigerant tube B. The third slant portion B4 is bent from an end portion, far from the first slant portion B2, of the second slant portion B3, and extends slantly with respect to the horizontal direction. The third slant portion B4 extends to be angled differently from the second slant portion B3.

The second slant portion B3 is slant to have a first end positioned adjacent to the first slant portion B2 and at a lower level, and a second end positioned adjacent to the third slant portion B4 and at a higher level. The third slant portion B4 is slant to have a first end positioned adjacent to the second slant portion B3 and at a lower level, and a second end positioned far from the second slant portion B3 and at a higher level. As depicted in FIG. 6, the second refrigerant tube B has a vertical portion B5 bent from the second end of the third slant portion B4 and extending upward.

As depicted in FIG. 6 to FIG. 9, the third refrigerant tube C includes the first connecting portion C1 and the horizontal portion C2, as well as a second slant portion C3 and a third slant portion C4. The second slant portion C3 is bent from an end portion, far from the first connecting portion C1, of the horizontal portion C2, and extends slantly with respect to the horizontal direction. The third slant portion C4 is bent from an end portion, far from the horizontal portion C2, of the second slant portion C3, and extends slantly with respect to the horizontal direction.

The second slant portion C3 is slant to have a first end positioned adjacent to the horizontal portion C2 and at a lower level, and a second end positioned adjacent to the third slant portion C4 and at a higher level. The third slant portion C4 is slant to have a first end positioned adjacent to the second slant portion C3 and at a lower level, and a second end positioned far from the second slant portion C3 and at a higher level. As depicted in FIG. 6, the third refrigerant tube C has a vertical portion C5 bent from the second end of the third slant portion C4 and extending upward. The second slant portion C3 and the third slant portion C4 are slant with respect to the horizontal direction by an angle having 15 or more degrees.

As depicted in FIG. 7, the second slant portion B3 of the second refrigerant tube B and the second slant portion C3 of the third refrigerant tube C are substantially in parallel with each other. The second slant portion B3 of the second refrigerant tube B and the second slant portion C3 of the third refrigerant tube C are aligned vertically. As depicted in FIG. 6, the third slant portion B4 of the second refrigerant tube B and the third slant portion C4 of the third refrigerant tube C are substantially in parallel with each other. The third slant portion B4 of the second refrigerant tube B and the third slant portion C4 of the third refrigerant tube C are aligned vertically.

As depicted in FIG. 8, the second slant portion B3 and the third slant portion B4 of the second refrigerant tube B are bent at an angle having about 90 degrees in a planar view. The second slant portion C3 and the third slant portion C4 of the third refrigerant tube C are bent at an angle having about 90 degrees in a planar view.

As depicted in FIG. 8 and FIG. 9, below the third slant portion B4 of the second refrigerant tube B and the third slant portion C4 of the third refrigerant tube C, the bottom plate 41 of the case 40 is provided with a second drain unit 54 having a second opening 41*b*. The second opening 41*b* is elongated in front and rear directions. The second opening 41*b* is disposed laterally adjacent to the first opening 41*a*. The second slant portions B3 and C3 and the third slant portions B4 and C4 have boundaries B6 and C6, respectively, which are positioned to be vertically overlapped with the second opening 41*b*.

As depicted in FIG. 8 and FIG. 9, at the second refrigerant tube B and the third refrigerant tube C, water such as condensate adhering to the third slant portions B4 and C4 flows downward along the third slant portions B4 and C4, and reaches the boundaries B6 and C6 between the third slant portions B4 and C4 and the second slant portions B3 and C3, respectively. Water flowing in the third slant portions B4 and C4 is inhibited from flowing at the boundaries B6 and C6, and is thus likely to drop downward. The boundaries B6 and C6 are positioned to be vertically overlapped with the second opening 41*b*, so that water dropping from the boundaries B6 and C6 is exhausted outside from the second opening 41*b*.

Water flowing from the third slant portions B4 and C4 to the second slant portions B3 and C3 beyond the boundaries B6 and C6, condensate adhering to the second slant portions B3 and C3, and the like flow further downward along the second slant portions B3 and C3, respectively. As depicted in FIG. 7, the second slant portions B3 and C3 have lower ends continuous to the lowermost end B2*b* and C2 of the second and third refrigerant tubes B and C, respectively. Water flowing along the second slant portions B3 and C3 thus drops from the lowermost ends B2*b* and C2 to be exhausted outside from the first opening 41*a*.

As depicted in FIG. 5A and FIG. 5B, the first refrigerant tube A, the second refrigerant tube B, and the third refrigerant tube C have second connecting portions A7, B7, and C7, respectively, which are disposed substantially horizontally and are connected to the liquid header 21. In the first refrigerant tube A, the second refrigerant tube B, and the third refrigerant tube C, the refrigerant tubes A, B, and C including the connecting tubes 35D to 35K at fourth lowest and upper ones are disposed vertically between the second connecting portions A7, B7, and C7 and the lowermost ends A3, B2*b*, and C2 of the refrigerant tubes A, B, and C, or are slant downward from the second connecting portions A7, B7, and C7 to the lowermost ends A3, B2*b*, and C2, respectively. Water adhering to the first to third refrigerant tubes A, B, and C is thus likely to flow toward the lowermost ends A3, B2*b*, and C2 between the second connecting portions A7, B7, and C7 and the lowermost ends A3, B2*b*, and C2, respectively, so that water dropping from the lowermost ends A3, B2*b*, and C2 can be exhausted outside from the first opening 41*a*.

Other Embodiments

Figure 10:
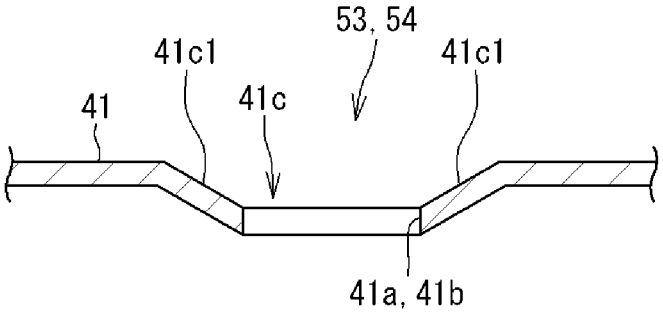
FIG. 10 is a sectional view of a drain unit provided at a bottom plate of a case according to one or more embodiments.

FIG. 10 is a sectional view of a drain unit provided at a bottom plate of a case according to one or more embodiments.

The first drain unit 53 having the first opening 41*a* and the second drain unit 54 having the second opening 41*b* (hereinafter simply referred to as the "opening 41*a* or 41*b*" or the "drain unit 53 or 54") can be configured as depicted in FIG. 10. The drain unit 53 or 54 depicted in FIG. 10 has a concave portion 41*c* concave downward from the bottom plate 41 and the opening 41*a* or 41*b* provided at a bottom portion of the concave portion 41*c*. The concave portion 41*c* has an upper surface 41*c*1 positioned adjacent to the opening 41*a* or 41*b* and slant to be decreased in level toward the opening 41*a* or 41*b*. When the drain units 53 and 54 are configured as depicted in FIG. 10, the lowermost ends A3, B2*b*, and C2 of the first to third refrigerant tubes A, B, and C may not be necessarily positioned to be vertically overlapped with the openings 41*a* and 41*b*, respectively, but may alternatively be positioned to be vertically overlapped with the concave portion 41*c*. Water dropping to the concave portion 41*c* flows toward the openings 41*a* and 41*b* due to a slant of the upper surface 41*c*1, and is exhausted outside from the openings 41*a* and 41*b*, respectively.

Alternatively, at the first slant portion B2 of the second refrigerant tube B, the first end B2*a* adjacent to the first connecting portion B1 may be positioned at a lower level and the second end B2*b* adjacent to the second slant portion B2 may be positioned at a higher level. In this case, the first end B2*a* of the first slant portion B3 constitutes the lowermost end of the second refrigerant tube B, so that the first end B2*a* of the first slant portion B2 is positioned to be vertically overlapped with the first opening 41*a*.

The outdoor heat exchanger 14 according to one or more embodiments faces the four side surfaces of the case 40. The outdoor heat exchanger 14 may alternatively have a substantially U shape in a planar view to face three side surfaces of the case 40.

Although the refrigerant flow divider 19 according to one or more embodiments is disposed diagonally backward left with respect to the liquid header 21, the refrigerant flow divider 19 may alternatively be disposed laterally to the liquid header 21 in the lateral directions X.

The above embodiments describe the air conditioner 1 assuming that the arrow Z indicates the vertical directions, the arrow Y indicates the front and rear directions, and the arrow X indicates the lateral directions. However, the present disclosure should not be limited to this case, and the arrow X may indicate the front and rear directions and the arrow Y may indicate the lateral directions.

Operation and Effects of Embodiments

The heat exchanger and the refrigerant tubes may have frost formed thereon during heating operation under a condition with low outdoor temperature. The air conditioner thus executes the defrosting operation while periodically flowing a refrigerant having high temperature to the heat exchanger in order to melt the frost. However, if water obtained by melting the frost at the refrigerant flow divider accumulates on a bottom plate of the air conditioner executing defrosting operation, the water may freeze during repeated heating operation and cause a phenomenon of gradually growing upward (an ice-up phenomenon).

Therefore, one or more embodiments of the present disclosure provide an air conditioner configured to appropriately exhaust outside, water adhering to a refrigerant tube of a refrigerant flow divider.

Operation and Effects (1) The air conditioner 1 according to the above embodiments includes the outdoor heat exchanger 14, the refrigerant flow divider 19 configured to divide and flow a liquid refrigerant to the outdoor heat exchanger 14, and the case 40 having the bottom plate 41 and accommodating the outdoor heat exchanger 14 and the refrigerant flow divider 19. The bottom plate 41 is provided with the first drain unit 53 having the first opening 41*a* for drainage. The refrigerant flow divider 19 includes the flow divider body 50 having the branching flow path, and the plurality of refrigerant tubes A, B, and C projecting downward from the lower surface 50*b* of the flow divider body 50, then bent, and connected to the outdoor heat exchanger 14 at a position above the lower surface 50*b*. The lowermost ends A3, B2*b*, and C2 of all the refrigerant tubes A, B, and C are positioned to be vertically overlapped with the first drain unit 53. Accordingly, even when water adhering to the surfaces of the refrigerant tubes A, B, and C drops from the lowermost ends A3, B2*b*, and C2 of the refrigerant tubes A, B, and C, respectively, the water can be exhausted outside the case 40 from the first drain unit 53.

(2) The lowermost ends A3, B2*b*, and C2 of the refrigerant tubes A, B, and C according to the above embodiments are positioned to be vertically overlapped with the first opening 41*a*. Accordingly, when water adhering to the surfaces of the refrigerant tubes A, B, and C drops from the lowermost ends A3, B2*b*, and C2 of the refrigerant tubes A, B, and C, respectively, the water can be exhausted outside the case 40 directly from the first opening 41*a*.

(3) As depicted in FIG. 6 and FIG. 7, at least one refrigerant tube (the second refrigerant tube) B according to the above embodiments includes the first connecting portion B1 connected to the lower surface 50*b* of the flow divider body 50 and projecting downward from the lower surface 50*b* of the flow divider body 50, and the first slant portion B2 bent from the lower end of the first connecting portion B1 to be slant with respect to the horizontal direction, and the lower end portion B2*b* of the first slant portion B2 constitutes the lowermost end. Accordingly, water adhering to the refrigerant tube B and reaching the first slant portion B2 flows downward along the first slant portion B2 and drops from the lower end portion of the first slant portion B2 to be exhausted outside the case 40.

(4) The first slant portion B2 according to the above embodiments is slant with respect to the horizontal direction by 15 or more degrees. Accordingly, water is likely to flow to the lower end portion of the first slant portion B2, and can drop from the lowermost end B2*b* of the refrigerant tube B.

(5) As depicted in FIG. 7, at least one refrigerant tube (the third refrigerant tube) C according to the above embodiments includes the first connecting portion C1 connected to the lower surface 50*b* of the flow divider body 50 and projecting downward from the lower surface 50*b* of the flow divider body 50, and the horizontal portion C2 bent from the first connecting portion C1 into the horizontal direction, and the horizontal portion C2 constitutes the lowermost end of the refrigerant tube C. Accordingly, water adhering to the refrigerant tube C and flowing to the horizontal portion C2 can drop within a range of the horizontal portion C2 to be exhausted outside the case 40.

(6) As depicted in FIG. 7 to FIG. 9, the bottom plate 41 according to the above embodiments is provided with the second drain unit 54 having the second opening 41*b* for drainage, and at least one refrigerant tube B or C includes, between the lowermost end B2*b* or C2 and the outdoor heat exchanger 14 (liquid header 21), the second slant portion B3 or C3 slant with respect to the horizontal direction, and the third slant portion B4 or C4 bent from the end portion of the second slant portion B3 or C3 to be angled differently from the second slant portion B3 or C3, respectively. The third slant portion B4 or C4 is slant with respect to the horizontal direction, in which the end portion adjacent to the second slant portion B3 or C3 is lower than the other end portion, and the boundary (bent portion) B6 or C6 between the second slant portion B3 or C3 and the third slant portion B4 or C4 is positioned to be vertically overlapped with the second drain unit 54, respectively. Accordingly, even when water adhering to the third slant portion B4 or C4 flows to the boundary B6 or C6 due to a slant of the third slant portion B4 or C4 and drops from the boundary B6 or C6, respectively, the water can be exhausted outside the case 40 from the second drain unit 54.

(7) As depicted in FIG. 6 and FIG. 7, the second slant portions B3 and C3 according to the above embodiments are slant to be increased in level toward the third slant portions B4 and C4, and the lower end portions of the second slant portions B3 and C3 are continuous to the lowermost ends B2*b* and C2, respectively. Water adhering to the second slant portions B3 and C3 flows along the second slant portions B3 and C3 to reach the lowermost ends B2*b* and C2 continuous to the lower end portions of the second slant portions B3 and C3, respectively. Accordingly, the water can drop from the lowermost ends B2*b* and C2 to be exhausted outside the case 40 from the first drain unit 53.

(8) The second slant portions B3 and C3 and the third slant portions B4 and C4 according to the above embodiments are slant with respect to the horizontal direction by 15 or more degrees. Accordingly, water adhering to the second slant portions B3 and C3 and the third slant portions B4 and C4 can flow to the lower end portions of the second slant portions B3 and C3 and the third slant portions B4 and C4, respectively.

(9) The refrigerant tubes A, B, and C according to the above embodiments include the second connecting portions A7, B7, and C7 connected to the liquid header 21 of the outdoor heat exchanger 14, and at least one of the refrigerant tubes A, B, and C is disposed vertically from the second connecting portion A7, B7, or C7 to the lowermost end A3, B2*b*, or C2, or is slant downward from the second connecting portion A7, B7, or C7 toward the lowermost end A3, B2*b*, or C2, respectively. Accordingly, water adhering to the refrigerant tube A, B, or C between the second connecting portion A7, B7, or C7 and the lowermost end A3, B2*b*, or C2 is likely to flow to the lowermost end A3, B2*b*, or C2 along the refrigerant tube A, B, or C, respectively.

(10) The first end and the second end of the outdoor heat exchanger 14 according to the above embodiments are disposed apart from each other, the first end of the outdoor heat exchanger 14 is connected with the refrigerant flow divider 19, and the second end of the outdoor heat exchanger 14 is connected with the gas header (gas side pipe) 22. When both the refrigerant flow divider 19 and the gas header 22 are connected to the first end of the outdoor heat exchanger 14, a high-temperature refrigerant flowing in the gas header 22 warms the periphery of the refrigerant flow divider 19 to be less likely to cause freezing of water adhering to the refrigerant flow divider 19 and freezing of water dropping to the bottom plate 41. When the refrigerant flow divider 19 and the gas header 22 are disposed separately at the first end and the second end of the outdoor heat exchanger 14 as in one or more embodiments, temperature around the refrigerant flow divider 19 is further decreased to be likely to cause freezing of water. It is accordingly more useful to configure the refrigerant tubes A, B, and C of the refrigerant flow divider 19 as described above.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner
14 outdoor heat exchanger
19 refrigerant flow divider
22 gas header (gas side pipe)
40 case
41 bottom plate
41*a* first opening
41*b* second opening
50 flow divider body
50*b* lower surface
53 first drain unit
54 second drain unit
A refrigerant tube
A3 lowermost end
A7 second connecting portion
B refrigerant tube
B1 first connecting portion
B2 first slant portion
B2*b* lowermost end
B3 second slant portion
B4 third slant portion
B6 boundary
C refrigerant tube
C1 first connecting portion
C2 horizontal portion
C3 second slant portion
C4 third slant portion
C6 boundary

What is claimed is:

1. An air conditioner comprising:

a heat exchanger;

a refrigerant flow divider causes a liquid refrigerant to be divided and to flow to the heat exchanger; and a case that:

comprises a bottom plate; and accommodates the heat exchanger and the refrigerant flow divider, wherein a first drain unit having a first opening for drainage is disposed on the bottom plate, the refrigerant flow divider comprises:

a flow divider body comprising a branching flow path; and refrigerant tubes that: project downward from a lower surface of the flow divider body and then bend upward to connect to the heat exchanger at a position above the lower surface, all of the refrigerant tubes have lowermost ends that are entirely within the first opening when viewed in a vertical direction, the first opening and the lowermost ends are opposite to each other in the vertical direction, a second drain unit having a second opening for drainage is disposed on the bottom plate, one or more of the refrigerant tubes each comprise between a corresponding lowermost end and the heat exchanger:

a first slant portion slant with respect to a horizontal direction; and a second slant portion bent from an end portion of the first slant portion and that is angled differently from the first slant portion, wherein the second slant portion is slant with respect to the horizontal direction, in which a first end portion of the second slant portion that is adjacent to the first slant portion is lower than a second end portion of the second slant portion, a boundary of the first slant portion and the second slant portion overlaps with the second drain unit when viewed in a vertical direction, the boundary is entirely within the second opening when viewed in the vertical direction, the second opening and the boundary are opposite to each other in the vertical direction, and the boundary is higher than the corresponding lowermost end.

2. The air conditioner according to claim 1, wherein one or more of the refrigerant tubes each comprise:

a first connecting portion connected to the lower surface of the flow divider body and that projects downward from the lower surface of the flow divider body; and a first slant portion bent from a lower end of the first connecting portion and that is slant with respect to a horizontal direction, and the first slant portion comprises a lower end portion constituting a corresponding lowermost end.

3. The air conditioner according to claim 2, wherein the first slant portion is slant with respect to the horizontal direction by 15 degrees or more.

4. The air conditioner according to claim 1, wherein one or more of the refrigerant tubes each comprise:

a first connecting portion connected to the lower surface of the flow divider body and that projects downward from the lower surface of the flow divider body; and a horizontal portion bent from the first connecting portion into a horizontal direction, and the horizontal portion constitutes a corresponding lowermost end.

5. The air conditioner according to claim 1, wherein the first slant portion is slant upward toward the second slant portion, and the first slant portion has a lower end portion continuous to the corresponding lowermost end.

6. The air conditioner according to claim 1, wherein the first slant portion and the second slant portion are slant with respect to the horizontal direction by 15 degrees or more.

7. The air conditioner according to claim 1, wherein the refrigerant tubes comprise second connecting portions connected to the heat exchanger, and one or more of the refrigerant tubes are:

disposed vertically between a corresponding second connecting portion and a corresponding lowermost end, or slant downward from a corresponding second connecting portion toward a corresponding lowermost end.

8. The air conditioner according to claim 1, wherein in a plan view, the heat exchanger has a first end and a second end that is apart from the first end, the first end of the heat exchanger is connected to the refrigerant flow divider, and the second end of the heat exchanger is connected to a gas side pipe.

9. The air conditioner according to claim 1, wherein the first drain unit comprises a concave portion that concave downward from the bottom plate, the first opening is disposed at a bottom portion of the concave portion, and the concave portion has an upper surface that is slant lower toward the first opening.

* * * * *